US006178020B1

(12) United States Patent
Schultz et al.

(10) Patent No.: US 6,178,020 B1
(45) Date of Patent: Jan. 23, 2001

(54) MODULES AND METHODS FOR ALL PHOTONIC COMPUTING

(75) Inventors: David R. Schultz, Knoxville; Chao Hung Ma, Oak Ridge, both of TN (US)

(73) Assignee: UT-Battelle, LLC, Oak Ridge, TN (US)

( * ) Notice: Under 35 U.S.C. 154(b), the term of this patent shall be extended for 0 days.

(21) Appl. No.: 09/409,980

(22) Filed: Sep. 30, 1999

(51) Int. Cl.[7] ..... G06E 1/13

(52) U.S. Cl. ..... 359/107; 359/108; 708/191; 708/831

(58) Field of Search ..... 359/107, 108; 708/191, 831

(56) References Cited

U.S. PATENT DOCUMENTS 5,623,360 4/1997 Gesell et al. .
5,751,243 5/1998 Turpin .

OTHER PUBLICATIONS

David Casasent, "Real time optical laboratory solution of parabolic differential equations", App. Opt. 27(14), pp. 2922–2925, Jul. 1988.*

Sing Lee, "Optical analog solutions of partial differential and integral equations", Opt. Eng. 24(1), pp. 41–47, Jan. 1985.*

M.A. Karim, et all, "*Electrooptic Displays for Optical Information Processing*", Proceedings of the IEEE 84, p. 814 (1996).

Real–Time Optical Information Processing, B. Javidi and J.L. Horner, eds. (Academic Press, NY; 1994).

R.P. Bocker, "*Optical digital RUBIC (rapid unbiased bipolar incoherent calculator) cube processor*", Optical Engeering, 23(1) (Jan./Feb. 1984).

J. Frisk, et al., "*Spatial Light Modulators Help Machines 'See' Faster*", Photonics Spectra (Feb. 1997).

P. Tayebati, et al., "*High–speed all–semiconductor optically addressed spatial light modulator*", Appl. Phys. Lett. 71(12):1610–1612 (Sep. 22, 1997).

C.S. Anderson, et al., "*Design and characterization of a long time aperture acouto–optic delay line*", Optical Engeering 34(1):7–14 (Jan. 1995).

S. Bartkiewicz, et al., "*Observation of high gain in a liquid–crystal panel with photoconducting polymeric layers*", Applied Optics 37(29):6871–6877 (Oct. 10, 1998).

* cited by examiner

*Primary Examiner*—Cassandra Spyrou
*Assistant Examiner*—Leo Boutsikaris
(74) *Attorney, Agent, or Firm*—Akerman, Senterfitt & Eidson, P.A.

(57) ABSTRACT

A method for all photonic computing, comprising the steps of: encoding a first optical/electro-optical element with a two dimensional mathematical function representing input data; illuminating the first optical/electro-optical element with a collimated beam of light; illuminating a second optical/electro-optical element with light from the first optical/electro-optical element, the second optical/electro-optical element having a characteristic response corresponding to an iterative algorithm useful for solving a partial differential equation; iteratively recirculating the signal through the second optical/electro-optical element with light from the second optical/electro-optical element for a predetermined number of iterations; and, after the predetermined number of iterations, optically and/or electro-optically collecting output data representing an iterative optical solution from the second optical/electro-optical element.

20 Claims, 6 Drawing Sheets

CONVENTIONAL DIAGONAL MATRIX MULTIPLICATION

$$\begin{bmatrix} a11 & a12 & a13 & a14 & a15 \\ a21 & a22 & a23 & a24 & a25 \\ a31 & a32 & a33 & a34 & a35 \\ a41 & a42 & a43 & a44 & a45 \\ a51 & a52 & a53 & a54 & a55 \end{bmatrix} \times \begin{bmatrix} b11 & 0 & 0 & 0 & 0 \\ 0 & b22 & 0 & 0 & 0 \\ 0 & 0 & b33 & 0 & 0 \\ 0 & 0 & 0 & b44 & 0 \\ 0 & 0 & 0 & 0 & b55 \end{bmatrix} = \begin{bmatrix} a11b11 & a12b22 & a13b33 & a14b44 & a15b55 \\ a21b11 & a22b22 & a23b33 & a24b44 & a25b55 \\ a31b11 & a32b22 & a33b33 & a34b44 & a35b55 \\ a41b11 & a42b22 & a43b33 & a44b44 & a45b55 \\ a51b11 & a52b22 & a53b33 & a54b44 & a55b55 \end{bmatrix}$$

*FIG. 2*

OPTICAL MATRIX DIAGONAL MULTIPLICATION

$$\begin{bmatrix} a11 & a12 & a13 & a14 & a15 \\ a21 & a22 & a23 & a24 & a25 \\ a31 & a32 & a33 & a34 & a35 \\ a41 & a42 & a43 & a44 & a45 \\ a51 & a52 & a53 & a54 & a55 \end{bmatrix} \times \begin{bmatrix} b11 & b22 & b33 & b44 & b55 \\ b11 & b22 & b33 & b44 & b55 \\ b11 & b22 & b33 & b44 & b55 \\ b11 & b22 & b33 & b44 & b55 \\ b11 & b22 & b33 & b44 & b55 \end{bmatrix} = \begin{bmatrix} a11b11 & a12b22 & a13b33 & a14b44 & a15b55 \\ a21b11 & a22b22 & a23b33 & a24b44 & a25b55 \\ a31b11 & a32b22 & a33b33 & a34b44 & a35b55 \\ a41b11 & a42b22 & a43b33 & a44b44 & a45b55 \\ a51b11 & a52b22 & a53b33 & a54b44 & a55b55 \end{bmatrix}$$

*FIG. 3*

BANDED MATRIX MULTIPLICATION

$$\begin{bmatrix} a11 & a12 & a13 & a14 & a15 \\ a21 & a22 & a23 & a24 & a25 \\ a31 & a32 & a33 & a34 & a35 \\ a41 & a42 & a43 & a44 & a45 \\ a51 & a52 & a53 & a54 & a55 \end{bmatrix} \times \begin{bmatrix} b11 & b12 & 0 & 0 & 0 \\ b21 & b22 & b23 & 0 & 0 \\ 0 & b32 & b33 & b34 & 0 \\ 0 & 0 & b43 & b44 & b45 \\ 0 & 0 & 0 & b54 & b55 \end{bmatrix} =$$

(MATRIX TIMES DIAGONAL)

$$\begin{bmatrix} a11 & a12 & a13 & a14 & a15 \\ a21 & a22 & a23 & a24 & a25 \\ a31 & a32 & a33 & a34 & a35 \\ a41 & a42 & a43 & a44 & a45 \\ a51 & a52 & a53 & a54 & a55 \end{bmatrix} \times \begin{bmatrix} b11 & b22 & b33 & b44 & b55 \\ b11 & b22 & b33 & b44 & b55 \\ b11 & b22 & b33 & b44 & b55 \\ b11 & b22 & b33 & b44 & b55 \\ b11 & b22 & b33 & b44 & b55 \end{bmatrix}$$

(MIRROR-SHIFTED MATRIX TIMES SUPERDIAGONAL)

$$+ \begin{bmatrix} 0 & all & a12 & a13 & a14 \\ 0 & a21 & a22 & a23 & a24 \\ 0 & a31 & a32 & a33 & a34 \\ 0 & a41 & a42 & a43 & a44 \\ 0 & a51 & a52 & a53 & a54 \end{bmatrix} \times \begin{bmatrix} 0 & b12 & b23 & b34 & b45 \\ 0 & b12 & b23 & b34 & b45 \\ 0 & b12 & b23 & b34 & b45 \\ 0 & b12 & b23 & b34 & b45 \\ 0 & b12 & b23 & b34 & b45 \end{bmatrix}$$

(MIRROR-SHIFTED MATRIX MATRIX SUBDIAGONAL)

$$+ \begin{bmatrix} a12 & a13 & a14 & a15 & 0 \\ a22 & a23 & a24 & a25 & 0 \\ a32 & a33 & a34 & a35 & 0 \\ a42 & a43 & a44 & a45 & 0 \\ a52 & a53 & a54 & a55 & 0 \end{bmatrix} \times \begin{bmatrix} b21 & b32 & b43 & b54 & 0 \\ b21 & b32 & b43 & b54 & 0 \\ b21 & b32 & b43 & b54 & 0 \\ b21 & b32 & b43 & b54 & 0 \\ b21 & b32 & b43 & b54 & 0 \end{bmatrix}$$

*FIG. 5*

MODULES AND METHODS FOR ALL PHOTONIC COMPUTING

STATEMENT REGARDING FEDERALLY SPONSORED RESEARCH OR DEVELOPMENT

This Invention was made with government support under contract DE-ACO5-96OR22464, awarded by the United States Department of Energy to Lockheed Martin Energy Research Corporation, and the United States Government has certain rights in this invention.

FIELD OF THE INVENTION

1. Field of the Invention

This invention relates to the field of optical computing and processing, and in particular, to solving partial differential equations with all photonic computing modules and all photonic methods for computing.

2. Description of Related Art

State of the art data processing and computational technologies have been enabled by the advances made in electronics, leading to increasing speed and power of digital computers. To obtain even higher speeds, a shift towards using parallel arrays of electronic computers has begun due to the limitations imposed by the smallest size, and therefore highest density, of manufacturable elements on a single processing chip.

A potentially revolutionizing force will be the utilization of photonic devices due to their high speed, large bandwidth, large volume data handling, compactness, low power consumption, ruggedness, and better isolation as compared with semiconductor electronics. Furthermore, photonic devices have an inherent capability for parallel computing in that every pixel of a two-dimensional (2-D) image can be processed at the same time.

For applications in engineering and science, the dominate portion of the available computation capacity is, and will be in the future, engaged in solving differential equations (PDEs). The solution of PDEs by computing apparatus can be accomplished effectively as an iterative process, requiring in many instances extraordinary computing capacity and speed. Differential equations govern the nature and behavior of physical systems and are thus crucial to understanding existing systems and designing new ones. For example, differential equations can be used to describe the flow of blood in the human body, the hydrodynamics of nuclear explosions, the aerodynamics of air flow over the wings of a plane, the propagation of electrons through semiconductors, the flexure of mechanical elements in buildings or bridges, and many other phenomena involving wave propagation, diffusion, heat transfer, hydrodynamics.

Electro-optical devices have been considered favorably as a means for information processing, as noted in the review article by M. A. Karim and A. S. Awwal, "Electro optic Displays for Optical Information Processing," *Proceedings of the IEEE* 84, p. 814, et seq. (1996) Nevertheless, no prior all photonic element computer module capable of solving differential equations exists, nor does any all photonic element computer module exist which is capable of closely related tasks. Only conventional electronic computers have been used to solve differential equations. The possibility of solving partial differential equations by optical means has been recognized, as noted by Karim and Awwal at page 823.

Optical Fourier transform and optical multiplication devices have been utilized in optical image processing and pattern recognition applications. These are discussed in the review by B. Javidi and J. L. Horner, eds. *Real-Time Optical Information Processing,* (Academic Press, New York, 1994).

The Essex Corporation has patented a particular implementation of an device which takes input of a function and performs the Fourier transformation, detecting and outputting the complex result.

Although the prior art is replete with hopeful predictions of what ought to be possible, and some limited progress in photonic computing has been made, there are no known descriptions, plans or designs which provide a full implementation of an all photonic computer module, which in particular addresses all the issues needing to be resolved in order to achieve an iterative solution of PDEs utilizing the Fourier transformation. Accordingly, a long-felt need for such an all photonic computer module, capable of solving PDEs in an interactive manner, is clearly established.

SUMMARY OF THE INVENTION

Modules and method for all photonic computing in accordance with the inventive arrangements satisfy the long-felt need of the prior art for an all photonic solution to complex PDEs, which is markedly faster and more efficient than is possible with presently available electronic computers.

In accordance with the inventive arrangements, and in recognition of the scientific and economic importance of solving differential equations, the appropriate algorithms for solving PDEs and at the same time capable of being implemented with only optical and electro-optical components have been selected. In order to implement such algorithms, modules and methods for all photonic computing in accordance with the inventive arrangements use practical optical and electro-optical devices, can be miniaturized, and can be replicated to produce large parallel arrays of modules, in order to achieve greatly increased computational power for a wide range of applications.

A tremendous operational speed advantage over conventional electronic computers can be realized for broad classes of engineering and science applications by taking advantage of the inherent speed and parallelism of an all photonic element computer module. The presently preferred embodiments, as taught herein, are capable of solving partial differential equations. The operations necessary to obtain these solutions are implemented using practical optical and electro-optical devices such as lenses and electronically or optically addressable spatial light modulators. The modules can be miniaturized and connected to form parallel arrays to further increase potential computational speeds and can be applied to solve other classes of mathematical, computational, processing, and simulation problems.

A photonic computing module, in accordance with the inventive arrangements, comprises: a first optical/electro-optical element; means for encoding the first optical/electro-optical element with a two dimensional mathematical function representing input data; a second optical/electro-optical element having a characteristic response corresponding to an iterative algorithm useful for solving a partial differential equation; an optical/electro-optical recirculation means including at least one of light delaying means and light boosting means; means for optically or electro-optically collecting output data; a first gate having a first and second modes of operation, the first mode of operation enabling light from the illuminated first optical/electro-optical element to illuminate the second optical/electro-optical element and the second mode of operation enabling light from the recirculation means to illuminate the second optical/electro-optical element; a second gate having first and second modes of operation, the first mode of operation enabling light from the illuminated second optical/electro-optical element to illuminate the collecting means and the second mode of operation enabling light from the illuminated second optical/electro-optical element to illuminate the feedback path; and, means for controlling the first and second gates such that after a beam of collimated light initially illuminates the first optical/electro-optical element and the first optical/electro-optical element initially illuminates the second optical/electro-optical element, an optical/electro-optical iterative solution path is formed by the second optical/electro-optical element, the second gate, the optical/electro-optical feedback path and the first gate, until after a predetermined number of iterations the second optical/electro-optical element illuminates the optical/electro-optical collecting means.

The photonic computing module can further comprise a plurality of optical/electro-optical elements operatively disposed between the first and second gates for performing a plurality of respective iterative functions. The respective iterative functions can comprise at least one of matrix multiplication, Fourier transform and reverse Fourier transform.

The photonic computing module can further comprise an optical phase detector operatively disposed between the second gate and the optical/electro-optical collecting means, the optical/electro-optical phase detector separating real and imaginary parts of the iterative optical solution.

The optical/electro-optical collecting means can comprise an array of optical/electro-optical detecting elements and/or an array of optical/electro-optical accumulating elements.

The photonic computing module can further comprise one or more mirror and/or half-mirror elements for directing the collimated beam onto one or more of the second optical/electro-optical element and the plurality of optical/electro-optical elements as a reference signal.

The photonic computing module can further comprise at least one mirror element for directing the collimated beam onto the phase detector as a reference signal.

The photonic computing module can further comprise: a plurality of the first optical/electro-optical elements, each of the plurality of first optical/electro-optical elements operating in parallel with one another and optically processing a respective bit of data; and, a plurality of the second optical/electro-optical elements, each of the plurality of first optical/electro-optical elements operating in parallel with one another and optically processing a respective bit of data.

The photonic computing module can further comprise an electronic computer for encoding the first optical/electro-optical element and/or for encoding the optical/electro-optical elements as necessary to implement the iterative functions and/or for electronically extracting the output data from the collecting means.

A method for all photonic computing, in accordance with the inventive arrangements, comprises the steps of: encoding a first optical/electro-optical element with a two dimensional mathematical function representing input data; illuminating the first optical/electro-optical element with a collimated beam of light; illuminating a second optical/electro-optical element with light from the first optical/electro-optical element, the second optical/electro-optical element having a characteristic response corresponding to an iterative algorithm useful for solving a partial differential equation; iteratively re-illuminating the second optical/electro-optical element with light from the second optical element for a predetermined number of iterations; and, after the predetermined number of iterations, optically and/or electro-optically collecting output data representing an iterative optical solution from the second optical/electro-optical element.

The method can further comprise the step of iteratively delaying the light from the second optical/electro-optical element before iteratively re-illuminating the second optical/electro-optical element, iteratively boosting the light from the second optical/electro-optical element before iteratively re-illuminating the second optical/electro-optical element, or both.

The method can further comprise the step of illuminating and iteratively re-illuminating a plurality of optical/electro-optical elements performing a plurality of respective iterative functions, the functions including one or more of matrix multiplication, Fourier transforming and reverse Fourier transforming.

The method can further comprise the step of optically and/or electro-optically separating real and imaginary parts of the iterative optical solution, after the predetermined number of iterations and prior to optically and/or electro-optically collecting the output data.

The method can further comprise the step of further using the collimated beam of light as a reference signal.

BRIEF DESCRIPTION OF THE DRAWINGS

FIG. 2 is useful for explaining conventional diagonal matrix multiplication.

FIG. 3 is useful for explaining an optical implementation of matrix diagonal multiplication in accordance with the inventive arrangements.

FIG. 5 is useful for explaining banded matrix multiplication in accordance with the inventive arrangements.

DETAILED DESCRIPTION OF THE PREFERRED EMBODIMENTS

The present computer module is primarily aimed at solving partial differential equations (PDEs) that are needed to model and understand physical systems as described in the Background section above. Simple, common two-dimensional (2-D) examples of such PDEs are the wave equation $$\frac{\partial^2 f}{\partial t^2} = v^2 \frac{\partial^2 f}{\partial x^2}, \tag{1}$$

the diffusion equation $$\frac{\partial f}{\partial t} = \frac{\partial}{\partial x}\left(D\frac{\partial f}{\partial x}\right), \tag{2}$$

and the Laplace equation $$\frac{\partial^2 f}{\partial x^2} + \frac{\partial^2 f}{\partial y^2} = g(x, y), \tag{3}$$

where f(x,y) is the 2-D function whose behavior is governed by the PDEs and v, D, and g(x,y) are various other specific constants. Each of the PDEs must be solved subject to appropriate boundary conditions.

In overview, an all photonic computing module can solve initial value and boundary value PDEs by implementing well-known iterative algorithms, for example, the Fourier transform, split operator, and relaxation methods, using optical rather than electronic elements to obtain much higher computational speeds. The key to obtaining the speed advantage is that all steps are performed optically or electro-optically, rather than creating bottlenecks of communication going between optics and electronics on 2-D arrays of numbers.

Figure 1:
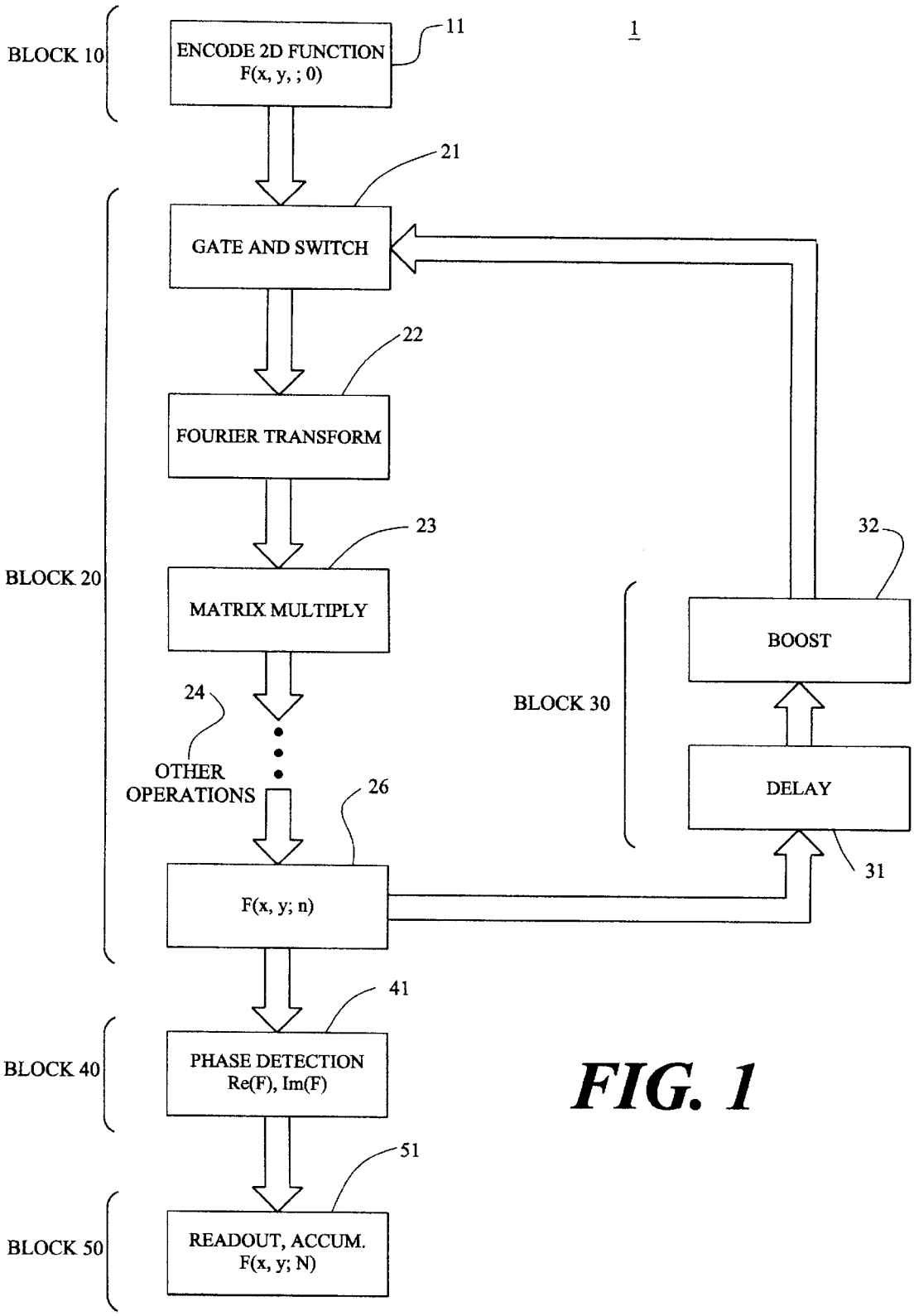
FIG. 1 is a block diagram useful for explaining optical computing in accordance with the inventive arrangements.

An all photonic computing module in accordance with the inventive arrangements is shown in FIG. 1 and comprises several functional blocks. The blocks are meant to be illustrative of the various kinds of operations that must be possible for practical use of a photonic computer. The steps undertaken in different ones of the blocks, in various combinations of the blocks and in all of the blocks, represent different methods for photonic computing in accordance with the inventive arrangements. Specifically, the module must do the following:

Block 10 is shown as having only one step 11, namely encoding a 2-D function for photonic processing. In the example, the module loads the 2-D function f(x, y), whose 2-D nature is represented in step 11 by f(x, y, 0) where the third dimension represented by the z-axis is not present. The 2-D function f(x, y) representing the physical quantity under consideration is loaded by the electro-optical encoding device and illuminated so that by either transmission or reflection the encoded function can be transmitted to subsequent optical/electro-optical stages. The function f(x,y) can be, for example, values of the temperature of a medium in a two-dimensional array whose time evolution is governed by the differential equation to be solved. The values of the function are the grey levels encoded in the electro-optical device such as an electronically-addressable spatial light modulator (ESLM) which can be driven by a signal from a conventional electronic computer. Alternatively, and in order to provide a higher accuracy solution which will be necessary in certain applications, the function can be encoded in a digital manner through the use of an array of modules, each encoding and operating on a single bit of a multi-bit representation of the input function. Accordingly, when reference is made in the specification and drawings to modules, it should be understood that reference is also being made to ganged sets of modules which will do all of the steps in unison on each of the bit planes, which are finally read out. If the time evolved function is complex (i.e., mathematically having both a real and an imaginary part), phase coherent illumination (e.g., from a laser) must be used so that subsequent operations act on the amplitude and phase of the signal to preserve these real and imaginary components. Alternate implementations can include, for example, input directly from an optical memory (e.g., a holographic memory), an array of fiber optic interconnections, a modulated array of phase locked lasers, or other schemes. Also, other implementations can be devised in which the real and imaginary components of the complex function are encoded separately with an accompanying need to modify the arrangement of subsequent processing elements. Treatment of higher dimensional functions would require parallel groups of modules, or serial operations on 2-D subarrays which are later properly combined.

Block 20 includes various operations. In order to solve a differential equation desired, the input signal from block 10 is passed through a number of optical and electro-optical elements which manipulate the signal by performing various mathematical operations, the results of which are then re-circulated (as explained in connection with block 30) through the set of elements to iteratively reach a solution.

The sequence and actions of the operations will be tailored to implement the solution of particular differential equations. A computer module designed to solve one specific differential can be created in which the order of the mathematical operations is fixed. Alternatively, more general purpose modules can be created in which switching elements (e.g. gates, mirrors, beam splitters, etc.) can be used to divert the signal through different sequences of elements. Furthermore, the composition of the elements that perform specific operations can have alternatives, some of which are described below, suited best for different situations or to incorporate new technologies.

Several pertinent mathematical operations which can have all optical or electro-optical implementations include, but need not be limited to, the following processes illustrated in block 20.

Step 22 is a Fourier transformation (FT), central to many algorithms used for numerically solving PDEs. This operation can, for example, transform the 2-D function from the spatial domain to the frequency domain, or from the frequency domain to the spatial domain. It is well known that the FT of a 2-D function is produced when it is passed through a lens. Furthermore, the FT is used in many existing optical/electro-optical systems, such as optical comparators used to recognize patterns. One particular realization of the FT of a complex function which fully handles the real and imaginary parts of the function is a commercial, patented module called ImSyn™ by Essex Corporation.

The process of step 23 is an optical matrix-matrix multiplication, referred to in the lexicon of the art as a matrix multiply. In this case, multiply and multiplies are used as nouns to denote the multiplication process or the result of a multiplication process. Optically, two matrices are multiplied element-by-element as illustrated in FIG. 3, rather than in the usual mathematical definition of matrix multiplication in which the elements of a row are multiplied by elements of a column and then added together to produce each resultant matrix entry, as shown in FIG. 2.

The solution of PDEs such as those governing many real physical situations can involve multiplication of the input function by a matrix in this element-by-element fashion, for example, the solution of time-dependent Schrödinger equation as explained later in connection with FIG. 7.

Figure 4:
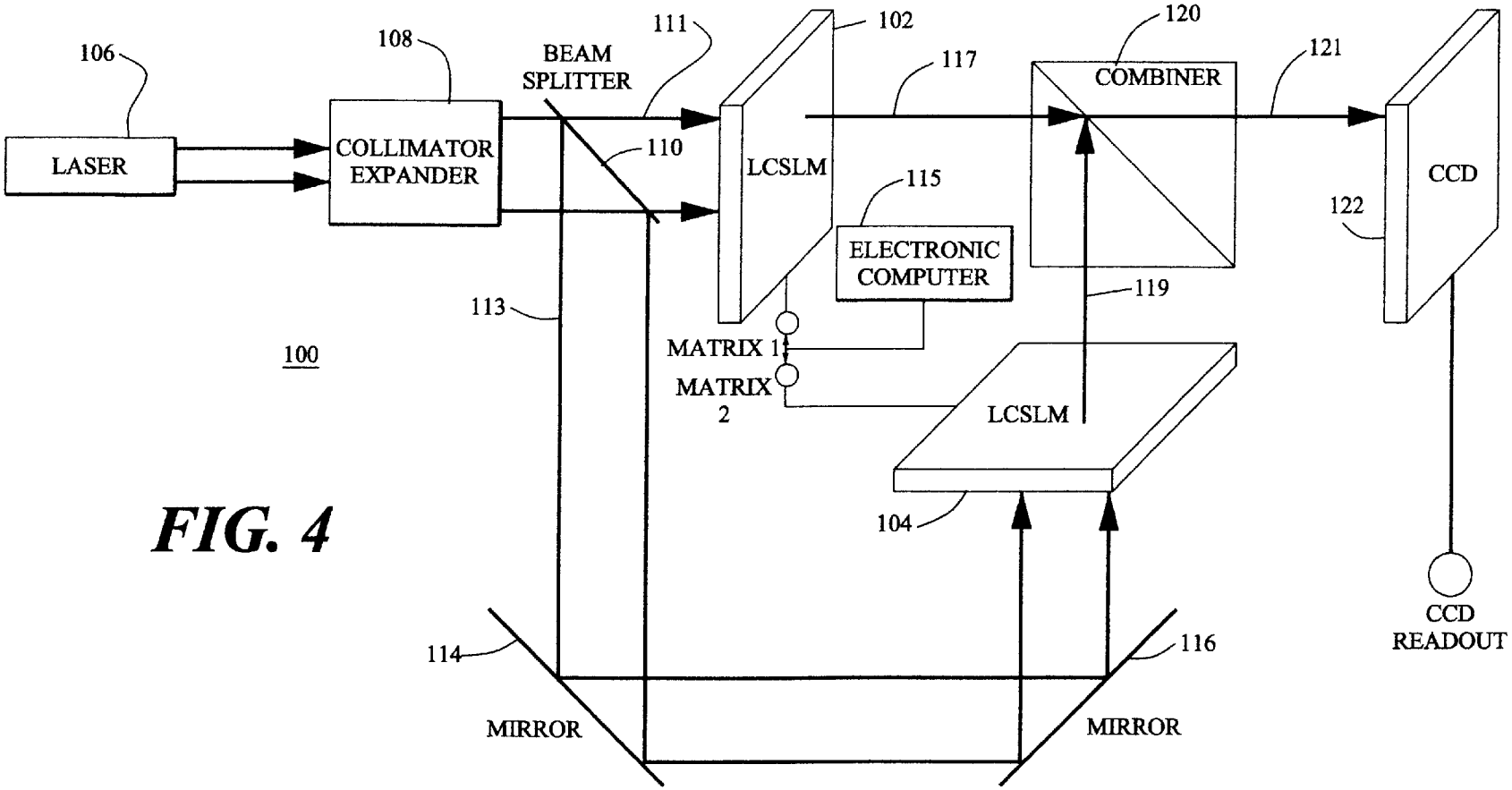
FIG. 4 is a diagram of a photonic computing module in accordance with the inventive arrangements and configured for solving the matrix diagonal multiplication shown in FIG. 3.

Additionally, multiplication by a function which can be represented by diagonal matrices often occurs. This form of operation is accomplished by matrix-diagonal-matrix multiplication, through an appropriate encoding of the elements of the diagonal matrix. This optical process can be used to obtain the correct matrix-diagonal-matrix multiplication as illustrated in FIG. 3. In the photonic computing module 100 shown in FIG. 4, a matrix f(x,y) with elements $a_{11}$, $a_{12}$, . . . , and denoted Matrix 1, is encoded on a first SLM and the representation of the diagonal matrix with elements $b_{11}$, $b_{22}$ . . . , and denoted Matrix 2, is encoded on a second SLM 104. The SLM can be implemented in a number of ways, including for example, by a liquid crystal SLM (LCSLM) or a ferro-electric SLM (FESLM). A conventional electronic computer 15 can supply the signals for encoding Matrix 1 and Matrix 2. A laser beam from laser 106 is focused by a collimator/expander 108. The collimated and expanded beam is divided by a half mirror or beam splitter 110. Beam splitter and half mirror are equivalent designations for purposes of this explanation. A first portion 111 illuminates the first SLM 102 on which Matrix 1 is encoded. A second portion 113 is reflected by mirrors 114 and 116, in order to illuminate the second SLM 104 on which Matrix 2 is encoded. The output beam 117 form SLM 102 illuminates a combiner 120. The output beam 119 form SLM 104 also illuminates the combiner 120, thus optically effecting the multiplication of Matrix 1 by Matrix 2. The output 121 of the combiner illuminates a CCD array 122. The CCD readout is an electronic version of the result of the optical/electro-optical multiplication, which can be returned to a conventional electronic computer, for example the computer 15, or another computer. Alternatively, the output can be used for encoding another SLM for further optical processing in another stage of the photonic computing module or in another photonic computing module. In this alternative, module 100 becomes a sub-module.

Alternate implementations of this module or sub-module can be appreciated based on the foregoing description. For example, rather than using a full 2-D SLM to encode the diagonal matrix, a linear, i.e. 1-D array can be used encode the diagonal elements $b_{11}$, $b_{22}$ . . . and then a cylindrical lens can fan out the linear array to produce the same pattern as the 2-D array in which the diagonal elements are simply repeated down the columns. In either the 1-D or 2-D scheme a conventional computer or electronic circuitry can provide the input driving signal to set up the matrix. Yet another alternative is the use of a transparent film that has a banded grey-scale pattern for cases in which the scalar function did not need to be updated or changed during the calculation. This matrix-diagonal-matrix multiplication can be generalized for the case of matrix-banded-matrix multiplication, as explained in the derivative operation below.

Another operation useful in certain schemes to solve PDEs is the derivative operator. This can be implemented numerically using a variety of approximations such as the well-known finite differences scheme. In this approach the derivative at a particular point ($x_i$) is given as a simple expression involving, for example, the value of the function at the points (. . . , $x_{i-2}$, $x_{i-1}$, $x_i$, $x_{i+1}$, $X_{i+2}$, . . . ). This amounts to a multiplication of the 2-D matrix representing the input function f(x,y) by a banded matrix. For example, in lowest order, the central differences scheme represents the derivative by a tri-diagonal matrix, such as shown in FIG. 5. Often, higher order approximations offer representations of higher fidelity, and correspond to adding more terms in the differencing scheme, and are thus banded matrices with successively more entries above and below the diagonal.

Very high order methods such as Fourier representations of the derivative are given by full matrices, i.e. matrices with primarily all non-zero entries. Thus, since full matrix by full matrix multiplication optically is still an open area of investigation, the use of low order finite difference schemes to reduce the derivative operation to matrix-banded-matrix multiplication is presently preferred. This can be accomplished by combining the output of shifted matrix-diagonal-matrix multiplies.

In order to solve the PDE iteratively, as is the aim of the present computer module, the proper sequence of operations described in Block 2 above must be implemented over and over again. Thus, in principle one could arrange enough copies of the submodules implementing the operations to reach the desired final solution. However, since potentially thousands or more iterations of a basic cycle through the operations might typically be needed, this is impractical for at least two reasons. First, it would be extremely inefficient and costly to reproduce the thousands of optical/electro-optical elements. Second, transmission through the elements is accompanied by loss of signal, and after passage through a certain number of elements, the signal to noise ratio would be so low that no practical information could be extracted. Thus, to make a sufficiently efficient system a means for recirculating the signal through the basic elements and a means for boosting the signal are needed. Accordingly, block 30 provides a boost step 32.

One way to boost the signal is to read out, with a CCD array or other such device, the state of the function after one cycle through the elements, and then perform a second iteration through the elements by transmitting the electronically outputted signal back to the initial encoding device. This would, however, be such a slow operation that no practical speed up over conventional fully electronic solutions could be obtained. A more practical solution is to use a system of mirrors at the output of the cycle to re-introduce the signal into the entrance to the cycle. This requires the introduction of gating and delaying elements so that a time structure can be introduced to separate cycles through the elements. Accordingly, block 30 provides a delay step 31 and block 20 provides a gating and switching step 21.

Since the update or readout times with which present day electro-optical devices such as the ESLMs or OSLMs used in the matrix multiplies is on the order of milli-seconds to micro-seconds or faster, practical optical/electro-optical delay lines, based for example on fiber optics, can not provide nearly enough delay. Practical devices capable of introducing milli-second to micro-second delays of 2-D arrays of pixels are the Multiple-Quantum-Well, Separated-Detector-Modulator (MQWSDM) device and the Acousto-Optic Delay (AOD) device.

Alternative methods of introducing the needed delay may become feasible. For example, vigorous research is ongoing world wide to create holographic memory. The output of a cycle of the present PDE solver could be fed into such a developed holographic memory and then read out after waiting, to initiate the next cycle. Other more exotic devices (e.g. a surface acoustic wave (SAW) optical delay line operating at cryogenic temperatures) are being developed and could eventually provide alternative delays with useful properties or efficiencies. Finally, since the OSLMs which could be used in the matrix multiplies have inherent rise times, schemes could be devised to exploit this with the proper gating to introduce the needed delay, albeit not as effectively as with a specialized device such as the MQWSDM or AOD.

The OSLMs which could be used in the matrix multiples might serve as a way to boost the circulating signal since the output of (transmission or reflection from) the scalar function OSLM is not recirculated but rather a CW signal. This procedure might introduce too much degradation of the S/N ratio. A potentially better solution is the use of a specialized OSLM which has recently been demonstrated to provide amplification of a 2-D signal.

Block 4. Phase detection—For those PDEs that intrinsically have functions f(x,y) which are complex, or for those that are solved using the FT method which introduces complex functions by virtue of taking the FT, a method for extracting the real and imaginary parts of the signal which are found from the amplitude and phase of the signal is needed. Accordingly, a phase detection block 40 provides a phase detection step 41, in which the real part of the solution Re(f) and the imaginary part of the solution Im(F) are preserved. Various interferometric schemes can be implemented, such as that shown in FIG. 6, or as in the Essex Corporation device ImSyn™ mentioned above.

Figure 6:
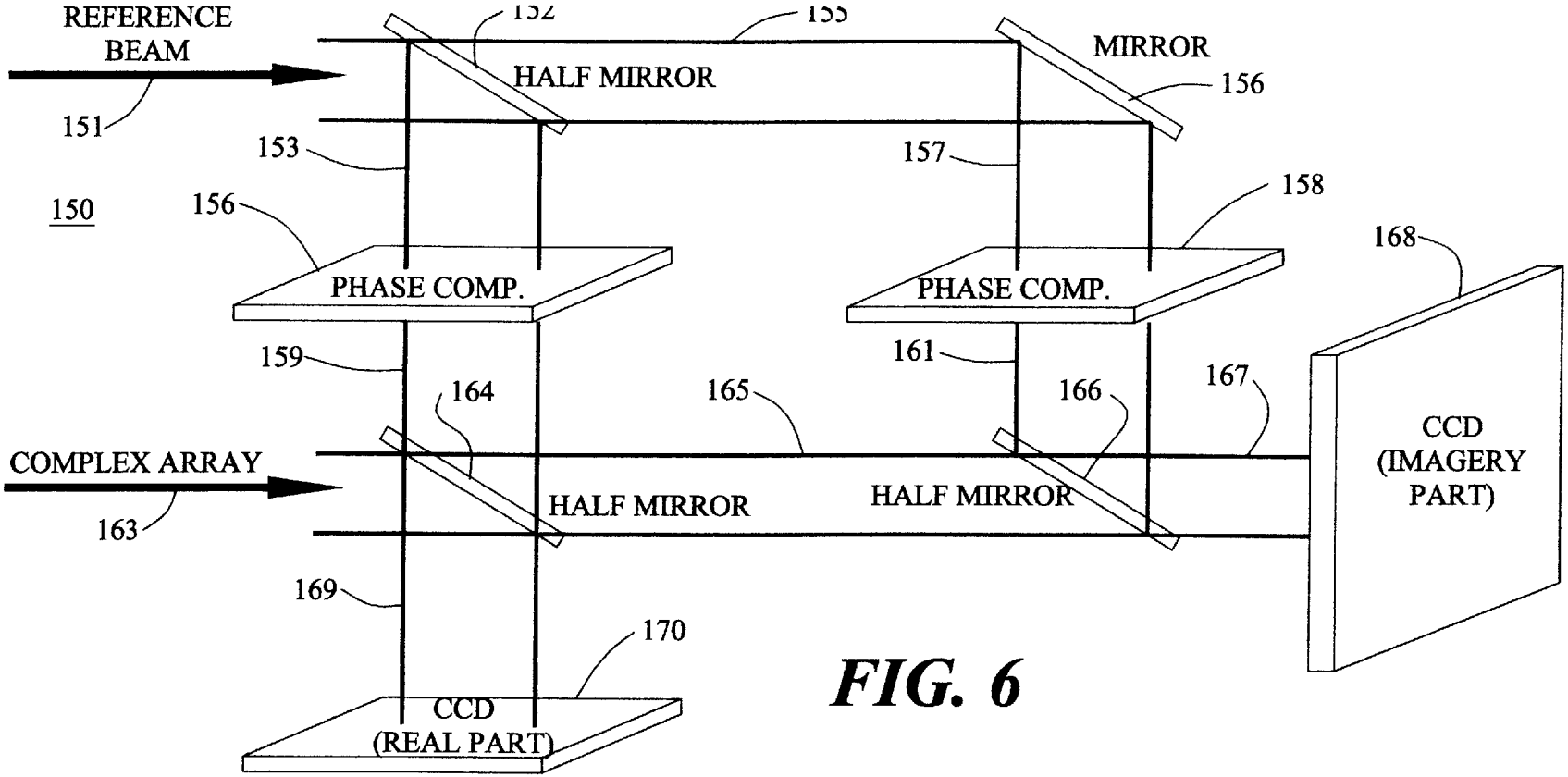
FIG. 6 is a diagram of a photonic computing module in accordance with the inventive arrangements and configured for interferometric processing of complex functions.

A photonic computing module, or sub-module, 150 configured as a phase detector for complex signals is shown in FIG. 6. A reference beam 151 is divided by a half mirror 152. A first portion 153 of the beam 151 illuminates a first phase comparator 156. The output of phase comparator 156 is beam 159. A second portion 155 of the beam 151 is reflected by a mirror 156 so as to illuminate a second phase comparator 158. The output of phase comparator 158 is beam 161. A beam 163 representing a complex solution array is directed to a half mirror 164 and a half mirror 166. Half mirror 164 combines beam 163 with beam 159, and the combined output beam 169 illuminates a CCD array 170 for outputting the real part of the solution. Half mirror 166 combines beam 163 and beam 161, and the combined output beam 167 illuminates a CCD array 168 for outputting the imaginary part of the solution. Accordingly, it can be seen that the optical function provided by phase comparator 156 and half mirror 164 is to filter out the imaginary components of the complex array represented by beam 163, whereas the optical function provided by the phase comparator 158 and half mirror 166 is to filter out the real components of the complex array represented by beam 163. Thus, the real and imaginary components of the complex solution can be retained for analysis.

Block 50 includes a readout and/or accumulating step 51. After a sufficient number of iterations (cycles) have been performed to reach the desired solution, or as many cycles have been performed as can be performed before the S/N ratio degrades too badly, the iterated f(x,y) can be read out using a device such as a CCD array or camera. Having the detected signal extracted electronically from a CCD or other similar device is advantageous because the detected signal can be then further processed. For example, the detected signal can be sent back to the encoding stage of block 10 for more iterations.

Either with the final result, or before being sent back, a number of image processing steps can be taken electronically and/or optically or electro-optically to improve the S/N ratio of the result or to otherwise enhance the information content of the output signal. These techniques can include, for example, the accumulation of several frames to be added together. This is a common practice in astronomy where large telescopes equipped with CCD cameras image faint objects most efficiently by adding several relatively short exposures, to limit the effects of noise and to produce a strong signal. Further, other image processing techniques can be used, for example filtering, averaging, smoothing, sharpening, and the like, depending on the application.

Specific modules and devices for implementing optical computing functions have been identified above, but detailed engineering development to build a working device can lead to selection of alternative components and/or the combination of functions of individual elements. For example, matrix multiplies can be implemented with ESLMs or OSLMs, and future devices might combine the ability to delay and boost the signal with a single element.

Figure 7:
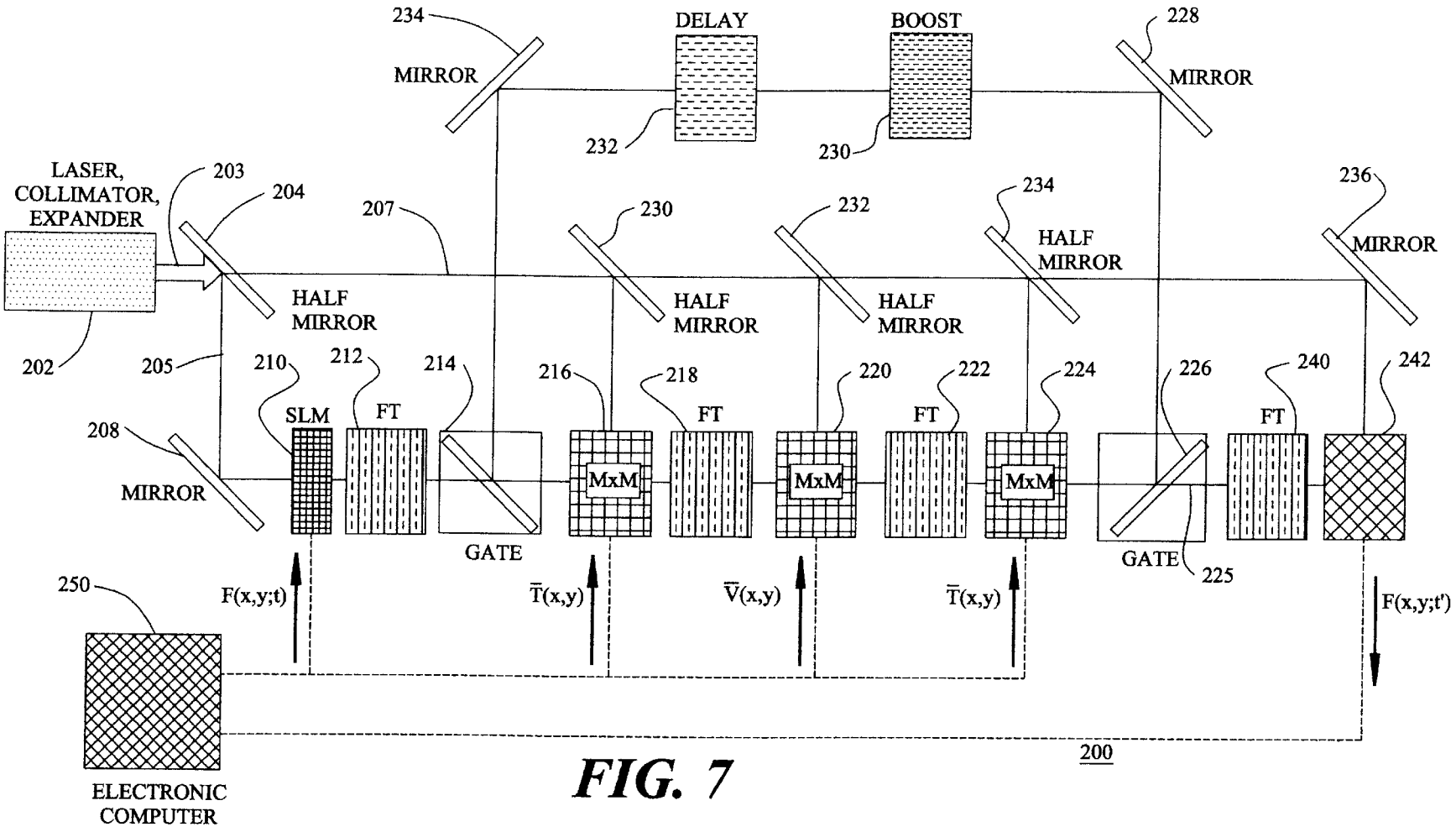
FIG. 7 is a diagram of a photonic computing module in accordance with the inventive arrangements and configured to solve the time-dependent Schrödinger equation.

In order to illustrate how a variety of optical computing elements and steps can be combined to solve a particular initial value PDE, a photonic computing module 200 for solving the time-dependent Schrödinger equation (TDSE) is shown in FIG. 7. For simplicity, the broad, modulated laser beam circulating through the module is indicated as a thin solid line. The dashed lines indicate electronic signals to and from a conventional computer.

The TDSE has the form of a diffusion equation in complex time. The TDSE governs the evolution of objects on the microscopic scale such as in atomic, molecular, nuclear, and solid state physics, disciplines necessary for the understanding of a wide range of phenomena of both fundamental and practical interest. As such, the TDSE serves as a good illustrative example of a class of PDEs whose solution can profitably benefit from very high speed computation, and in particular, optical computation in accordance with the inventive arrangements.

A method of solution that is ideally matched with the available optical/electro-optical techniques is termed the split operator method. In the form that is applicable to the TDSE, the split operator method consists of two types operations, one consisting of Fourier transformation and the other an element-by-element matrix-matrix multiplication. In particular, the basic steps described above in connection with FIG. 1 are used to advance an initial value of the function considered to a final solution. These steps are explained in connection with module 200 and indicate the best currently available corresponding optical processing operation for each.

The 2-D TDSE in Cartesian coordinates is $$i\frac{\partial\psi}{\partial t} = -\frac{1}{2}\nabla^2\psi + V\psi, \tag{4}$$

for a particle represented by the wave function $\psi=V(x,y)$ of unit mass moving subject to a potential $V=V(x,y)$. Here $\nabla^2=\partial^2/\partial x^2+\partial^2/\partial y^2$ is the Laplacian operator and apart from a constant factor, is the kinetic energy operator, $T=(\frac{1}{2})\nabla^2$. The constant i is the square root of negative-one (−1).

A laser, collimator and expander are represented by block 202, and together provide a beam 203 for driving the optical computing. A half mirror 203 divides the beam into a first beam 205 directed to mirror 208 and a second beam 207 directed to half mirror 230, half mirror 232, half mirror 234 and mirror 236.

As the first step, the initial 2-D function $\psi(x,y)$ is encoded by illuminating an electronic SLM 210 on which the function's values at points (x,y) are encoded in the grey-levels of the array of pixels, the function being supplied by an output of electronic computer 250. As noted, higher accuracy can be encoded in a digital manner through the use of an array of modules, each encoding and operating on a single bit of a multi-bit representation of the input function.

Operations are then performed to implement the time propagation of the initial functions using the split operator method. In other words, it is necessary to take $\psi$ at a given time t and advance the solution of the TDSE by a time increment $\delta t$ as $$\psi_{t+\delta t}=exp(-\tfrac{1}{2}iT\delta t)\ exp(-iV\delta t)\ exp(-\tfrac{1}{2}iT\delta t)\psi_t. \tag{5}$$

By Fourier transforming $\psi$ into momentum space, the action of the exponential operators take on a simplified form allowing the use of element-by-element matrix multiplication.

Limitations of this propagation scheme exist and alternatives using similar methods can be preferable for particular cases, for example, using a form of the propagator that uses matrix-banded-matrix multiplication to implement the propagation $$\psi_{t+\delta t} exp(-i\delta t(T+V))\psi_t, \tag{6}$$

directly by a Taylor expansion of the exponential. That is, perform operations such as optically adding the results of repeated applications of T, represented by, for example, a low-order finite difference (banded matrix) derivative operation, on $\psi$.

Accordingly, the light from the SLM 210 then passes through a lens 212 which results in the Fourier transform of the function. Depending on the engineering of the practical module, the SLMs used can be either transmissive or reflective, but for convenience here and below, an assumption is made that the SLMs are transmissive. Thus, the use phrases like "passes through the SLM" are to be found herein, where this might in other designs be replaced by "is reflected from the SLM". This step takes the wave function from configuration space to momentum space, that is as explained above, transforms from the spatial domain to the frequency domain.

The Fourier transformed 2-D function passes through gate 214 and is multiplied, by matrix-matrix multiplication device 216, element-by-element with a matrix representing the free propagator in momentum space for a half time step. The matrix is supplied by an output of the electronic computer 250. Beam 207 is reflected to device 216 by half mirror 230. Matrix-matrix multiplication device 216 operates as explained in connection with module 100, or in this embodiment sub-module 100, shown in FIG. 4. The momentum space operator is $$\overline{T} \equiv \left[e^{-i\frac{\delta t}{2}ET}\right] = \left[e^{-i\frac{\delta t}{2}(T_x+T_y)}\right] \tag{7}$$

where $\delta t$ is the time step. $T_x$ and $T_y$ are the components of the operator T and are diagonal matrices composed of the momentum space eigenvalue of kinetic energy on the given lattice of (x,y) points. Because the operators are diagonal in momentum space, the matrix-matrix multiplication appropriate is element-by-element multiplication, i.e. in terms of the elements labeled by indices i and j, $\overline{T}_{ij}\times\psi_{ij}$.

The result of the matrix multiply in device 216 is passed through a second Fourier transform lens 218, returning the wave function to configuration space.

The output of the lens 218 is multiplied in device 220 by the exponential potential function term, $$\overline{V}(t) \equiv \left[e^{-i\frac{\delta t}{2}V}\right] = \left[e^{-i\frac{\delta t}{2}(V_x(t)+V_y(t))}\right]. \tag{8}$$

Beam 207 is directed to device 220 by half mirror 232. As in the $\overline{T}$ case, this matrix multiplication is element-by-element by virtue of the diagonal character of $V_x$ and $V_y$. The potential may be static, i.e. ~independent of time, or more generally time-dependent ($\overline{V}$(t)) in which case it must be updated each time step, or each several time steps when appropriate, by electrically or electro-optically addressing the SLM which encodes it. This is a step which is dependent on there being a delay step in the sequence so that the relatively slow (milli-seconds to micro-seconds or faster) update of this electro-optical device can be accomplished.

The output of device 220 is Fourier transformed with another lens 222 back to momentum space and transmitted to the next device 224, which performs a second half time step as explained in connection with device 216. The output of device 224 is directed by a gate 226, along a selected one of paths 225 and 227. Path 227 is selected until a sufficient number of iterations have been processed.

At this point, one time step ($\delta t$) has been taken, so it is therefore necessary to loop back through these operations as many times as is necessary to reach the desired number of time steps. Accordingly, the other output of half mirror 226 denoted as beam 227 is directed to mirror 228. Mirror 28 is the input to the iteration loop, formed by boost block 230, delay block 232 and mirror 234, all of which generally correspond to block 30 of FIG. 1. The iteration loop enters the main processing path at gate 214, between lens 212 and device 216.

An immediate economy which can be exploited in the process of looping back can be noted here. Device 240 transforms the wave function to configuration space from momentum space and the next step, a return to lens 212 would then take the wave function back to momentum space. Thus, to avoid the double FT, the method loops back after device 224, and reenters the processing sequence after lens 212.

Several operations are necessary to implement the recirculation. Simply using a set of mirrors to direct the signal coming out of device 224 and back into device 216 would result in an overlap of the photons reflected through the loop. Thus, it is necessary to introduce a delay in the signal using a device such as the MQWSDM or AOD as described above in connection with block 30 of FIG. 1. The delay also serves to allow time (milli-seconds or micro-seconds or faster with present day devices) for the potential function {V} to be updated by electronically addressing the appropriate SLM if the potential has a time dependence. Thus, the delay acts as a kind of gate to introduce a time structure into the signal to allow the non-overlapping loop back and update cycle for the potential SLM. A portion of the needed delay can also be introduced due to finite response times of the OSLMs used in the multiplies.

In addition, since some photons are lost in passing through the lenses and SLMS, the signal will have to be periodically boosted, also as explained in connection with block 30 of FIG. 1. This can be a separate element or elements such as the specialized OSLM described in block 30 and/or boosting which takes place using the OSLMs in the multiply steps. Also, in order to reduce noise levels amplified by the boosting which can reduce the S/N ratio, optical/electro-optical filtering techniques, for example optical low-pass filtering by using appropriate masks in the frequency domain can be used.

After the desired number of iterations have been performed, the beam is directed along path 225, and transformed back to configuration space by lens 240. The result is available as the output of lens 240, which is detected and/or accumulated by phase detector, to obtain the configuration space form of the function. Then, the real and imaginary parts of the function would be determined by interferometric analysis as explained in connection with module 150, or in this embodiment sub-module 150, shown in FIG. 6. Thus, the real part of the solution can be directed to a CCD camera or array or other similar device, being detected as a amplitude; and, the imaginary part of the solution can be directed to another CCD camera or array or other similar device. The camera outputs can be read by electronic computer 250. If the output signal is weak, a number of identical input signals can be propagated, detected, and combined, that is accumulated, to enhance the S/N ratio.

In comparison to the solution of PDEs by conventional electronic computers, the all photonic computing modules and methods use only optical/electro-optical elements, therefore providing greatly enhanced computational speed. Other significant advantages of the inventive arrangements include, for example, an ability to iteratively solve differential equations for a wide class of scientific and engineering applications, potential application to solve other classes of problems, and an ability to miniaturize the modules and form array of modules in large parallel platforms.

The modules can be made as hard-wired specialized modules to solve one or a small class of particular problems, or can be implemented with switching elements to exhibit a more flexible architecture to solve broader classes of problems. Alternative optical/electro-optical devices can be substituted to perform certain of the functions described, particularly for operations such as the delaying and boosting of the signal. The module can be miniaturized along the lines envisioned for other electro-optical devices, such as optical correlators, so that several or many modules can be operated together in parallel. Other mathematical, computational, processing, and simulation problems can be solved using the basic concepts and design of the all photonic element computer modules and methods according to the inventive arrangements.

What is claimed is:

1. A photonic computing module, comprising:

a first optical/electro-optical element;

means for encoding said first optical/electro-optical element with a two dimensional mathematical function representing input data;

a second optical/electro-optical element having a characteristic response corresponding to an iterative algorithm useful for solving a partial differential equation;

an optical/electro-optical recirculation means including at least one of light delaying means and light boosting means;

means for optically or electro-optically collecting output data;

a first gate having a first and second modes of operation, said first mode of operation enabling light from said illuminated first optical/electro-optical element to illuminate said second optical/electro-optical element and said second mode of operation enabling light from said recirculation means to illuminate said second optical/electro-optical element;

a second gate having first and second modes of operation, said first mode of operation enabling light from said illuminated second optical/electro-optical element to illuminate said collecting means and said second mode of operation enabling light from said illuminated second optical/electro-optical element to illuminate said recirculation means; and, means for controlling said first and second gates such that after a beam of collimated light initially illuminates said first optical/electro-optical element and said first optical/electro-optical element initially illuminates said second optical/electro-optical element, an optical iterative solution path is formed by said second optical element, said second gate, said optical recirculation means and said first gate, until after a predetermined number of iterations said second optical element illuminates said optical collecting means.

2. The photonic computing module of claim 1, further comprising a plurality of optical/electro-optical elements operatively disposed between said first and second gates for performing a plurality of respective iterative functions.

3. The photonic computing module of claim 2, wherein said respective iterative functions comprise at least one of matrix multiplication, Fourier transform and reverse Fourier transform.

4. The photonic computing module of claim 1, further comprising an optical phase detector operatively disposed between said second gate and said optical/electro-optical collecting means, said optical phase detector separating real and imaginary parts of said iterative optical solution.

5. The photonic computing module of claim 1, wherein said optical/electro-optical collecting means comprises an array of optical detecting elements.

6. The photonic computing module of claim 1, wherein said optical/electro-optical collecting means comprises an array of optical accumulating elements.

7. The photonic computing module of claim 1, further comprising at least one mirror element for directing said collimated beam onto said second element as a reference signal.

8. The photonic computing module of claim 2, further comprising at least one half-mirror element for directing said collimated beam onto at least two of said plurality of optical/electro-optical elements as a reference signal.

9. The photonic computing module of claim 4, further comprising at least one mirror element for directing said collimated beam onto said phase detector as a reference signal.

10. The photonic computing module of claim 1, comprising;

a plurality of said first optical/electro-optical elements, each of said plurality of first optical/electro-optical elements operating in parallel with one another and optically processing a respective bit of data; and, a plurality of said second optical/electro-optical elements, each of said plurality of first optical/electro-optical elements operating in parallel with one another and optically processing a respective bit of data.

11. The photonic computing module of claim 1, further comprising an electronic computer for encoding said first optical/electro-optical element and for electronically extracting said output data from said collecting means.

12. The photonic computing module of claim 3, further comprising an electronic computer for encoding said optical/electro-optical elements as necessary to implement said iterative functions and for electronically extracting said output data from said collecting means.

13. A method for all photonic computing, comprising the steps of:

encoding a first optical/electro-optical element with a two dimensional mathematical function representing input data;

illuminating said first optical/electro-optical element with a collimated beam of light;

illuminating a second optical/electro-optical element with light from said first optical/electro-optical element, said second optical element having a characteristic response corresponding to an iterative algorithm useful for solving a partial differential equation;

iteratively recirculating said second optical/electro-optical element with light from said second optical/electro-optical element for a predetermined number of iterations; and, after said predetermined number of iterations, optically and/or electro-optically collecting output data representing an iterative optical solution from said second optical/electro-optical element.

14. The method of claim 13, further comprising the step of iteratively delaying said light from said second optical/electro-optical element before iteratively recirculating said second optical/electro-optical element.

15. The method of claim 13, further comprising the step of iteratively boosting said light from said second optical/electro-optical element before iteratively recirculating said second optical/electro-optical element.

16. The method of claim 13, further comprising the steps of iteratively boosting and delaying said light from said second optical/electro-optical element before iteratively recirculating said second optical/electro-optical element.

17. The method of claim 13, further comprising the step of illuminating and iteratively recirculating a plurality of optical/electro-optical elements performing a plurality of respective iterative functions.

18. The method of claim 17, comprising the step of iteratively performing at least one of matrix multiplication, Fourier transforming and reverse Fourier transforming.

19. The method of claim 13, further comprising the step of optically separating real and imaginary parts of said iterative optical solution, after said predetermined number of iterations and prior to optically and/or electro-optically collecting said output data.

20. The method of claim 13, further comprising the step of further using said collimated beam of light as a reference signal.

* * * * *